United States Patent [19]

Loos

[11] 3,992,897

[45] Nov. 23, 1976

[54] ROOM AIR CONDITIONER GROUNDING CLIP

[75] Inventor: John H. Loos, Dayton, Ohio

[73] Assignee: General Motors Corporation, Detroit, Mich.

[22] Filed: Sept. 2, 1975

[21] Appl. No.: 609,216

[52] U.S. Cl. ..... 62/262; 24/73 B; 24/81 B; 174/51; 174/58

[51] Int. Cl.[2] ..... F25D 23/12

[58] Field of Search ..... 24/73 B, 81 B; 174/51, 174/58; 339/14 R; 62/262

[56] References Cited

UNITED STATES PATENTS

| | | | |
|---|---|---|---|
| 3,021,581 | 2/1962 | Cook et al. | 174/51 X |
| 3,122,604 | 2/1964 | Cook et al. | 174/51 |
| 3,780,209 | 12/1973 | Schuplin | 174/51 |
| 3,792,593 | 2/1974 | Loos et al. | 62/262 |
| 3,810,069 | 5/1974 | Jaconette, Jr. | 339/14 R |
| 3,869,760 | 3/1975 | Meyer | 24/73 B |

*Primary Examiner*—William F. O'Dea
*Assistant Examiner*—Ronald C. Capossela
*Attorney, Agent, or Firm*—Edward P. Barthel

[57] ABSTRACT

An electrical grounding clip for grounding the outer casing of a room air conditioner to the base pan of the chassis in a manner to assure positive grounding contact upon the chassis being slidably inserted within the casing. The clip includes a U-shaped body portion forming two leaf portions normally oriented at an outwardly diverging angle, the casing engaging leaf being formed with a pair of spring legs and a cooperating lanced portion for engaging a pair of cooperating openings in the lower wall of the casing. The chassis engaging leaf portion includes an upwardly extending central cone having a sawtooth-like edge for resilient biased grounding connection with the chassis base pan.

3 Claims, 7 Drawing Figures

ROOM AIR CONDITIONER GROUNDING CLIP

This invention relates to an air conditioner grounding clip and more particularly to an electrical grounding clip for grounding the room air conditioner outer casing to its removable chassis, the chassis being slidably inserted within the casing.

Prior art room air conditioners with outer casings fabricated of electrically conductive material have utilized various arrangments for grounding the casing to the removal chassis. One such arrangement requires a pair of grounding clips located on sliding rails adjacent each side wall of the casing for engaging the edge portions of the air conditioner chassis base pan upon its being slidably inserted within the casing.

The present invention involves the use of a single grounding clip located in the central portion of the casing bottom wall for effecting grounding contact by means of a resiliently biased portion of the clip engaging the undersurface of the chassis base pan upon the chassis being slidably inserted into the casing. In room air conditioners of the type disclosed in the present embodiment of the invention the manufacturing tolerances cause the underside of the chassis to be vertically spaced within a predetermined range from the casing. It is essential, therefore, that a single grounding clip have the capability to compensate for the dimensional tolerance variation between the chassis base and the casing bottom wall to establish a positive ground connection therebetween.

It is therefore an object of the present invention to provide a grounding clip for grounding the other casing of a room air conditioner to the base pan of the removable refrigeration chassis that is easily installed in a locked manner with the casing while providing a resiliently biased portion which provides a positive ground between the casing and pan despite dimensional variations resulting from the mass production line assembly of household appliances.

It is another object of the present invention to provide an improved grounding clip for use with room air conditioners capable of grounding an outer casing of electrical conductive material to the base pan of an inner refrigeration chassis removably positioned in the casing wherein the casing bottom wall has a rectangular opening and adjacent cooperating aperture formed therein with the aperture being symmetrical with and spaced a predetermined distance from the inboard transverse edge of the rectangular opening. The grounding clip comprises a single sheet of metal bent upon itself to provide a U-shaped member with a flat base leaf portion having an upwardly directed free end and a resilient leaf portion inclined to and rising from the opposite end of the flat base leaf portion with the base leaf having a tang struck therefrom adapted to be positioned within the aperture. Resilient tongues, lanced from each side of the base, are adapted to engage the undersurface of the casing bottom wall providing spring tongues, the tongues each having a sharp-cornered upwardly extending barb for resiliently contacting the undersurface of the casing bottom wall. The resilient leaf portion includes an upwardly extending substantially cylindrical portion struck therefrom with sawtooth edges adapted to bite into the chassis base pan thereby electrically grounding the casing through the electrical conductive components of the chassis refrigeration system.

Further objects and advantages will become apparent from the following specification, reference being had to the accompanying drawings of which:

Figure 1:
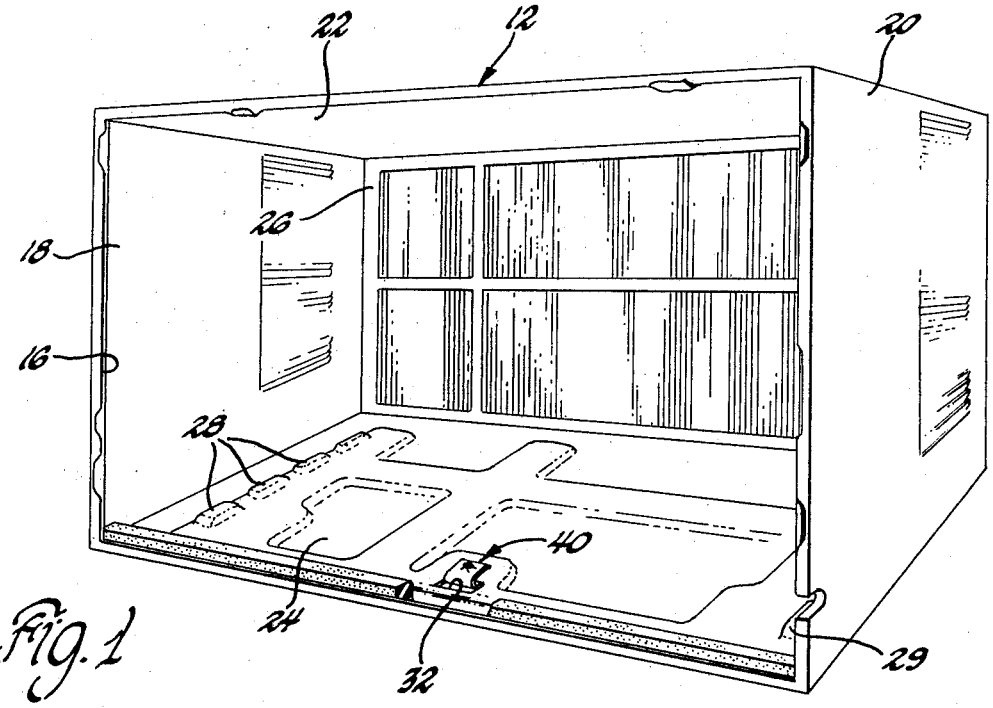
FIG. 1 is a perspective view of a room air conditioner outer casing, showing the location of the grounding clip.
Figure 2:
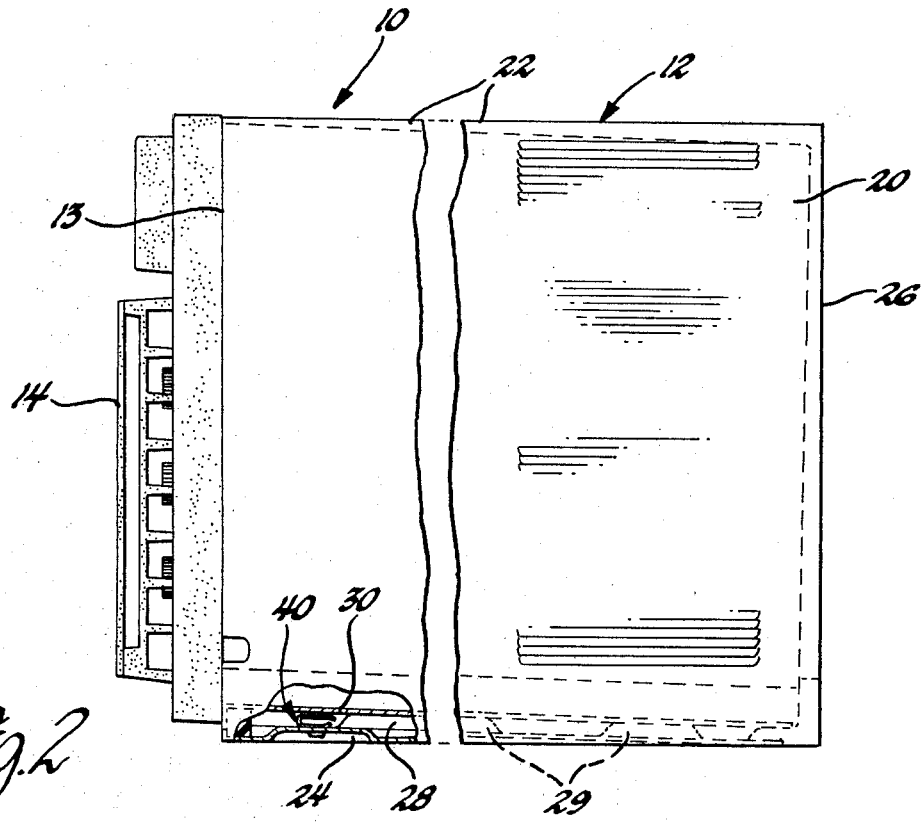
FIG. 2 is a vertical side elevational view of the room air conditioner with parts broken away to show the location of the grounding clip and the refrigeration chassis in operative position.

Referring now to the drawings and initially to FIGS. 1 and 2, there is illustrated in FIG. 2 a room air conditioner 10 of conventional construction including an outer cabinet wall sleeve or casing 12 defining an internal space having a room side flanged opened end portion 16. As seen in FIG. 2, the air conditioner normally includes a front grille 14 extending across the front portion 13 of the cabinet space 12. The casing, adapted to be arranged in a window or wall opening, is fabricated from sheet metal material and includes side walls 18 and 20, top 22 and bottom 24 walls and a back or outside louvered wall 26 defining the room-side opening 16 disposed in the enclosure to be air conditioned.

As seen in FIG. 1, the sleeve bottom wall 24 has upwardly deformed or raised portions 28 and 29 extending along each of the side walls 18 and 20 respectively, on which a refrigeration chassis assembly base pan 30 is slidably received. The chassis (not shown) includes a conventional refrigeration system for a room air conditioner such as shown, for example, in U.S. Pat. No. 3,792,593 issued Feb. 19, 1974, to J. H. Loos et al., assigned to the same assignee as the present application, the disclosure of which is incorporated by reference herein. The chassis base pan 30 fabricated from electrically conductive sheet metal material such as steel supports the refrigeration system which includes the usual compressor, evaporator and condenser.

The base pan 30 is electrically connected to the grounded refrigeration system components. As stated above, the prior art practice was to locate a separate grounding clip on each raised portion 28 and 29 intimately contacting the casing 12 such that when the chassis is positioned in the casing 12 such prior art grounding clips provided an electrical ground between the refrigeration system base pan 30 and the outer casing 12. Applicant's improved arrangement involves using a single unique clip member located at or closely adjacent to the longitudinal principal axis 38 of the casing bottom wall 24 so as to engage portions of both a rectangular work opening 32 and an adjacent aperture, preferably in the form of a circular hole 34, located a predetermined distance from inner transverse edge 36 of the work opening 32. It will be noted that the longitudinal centerline 38 of hole 34 substantially bisects the inner transverse edge 36 of the rectangular work opening 32 such that the hole 34 is symmetrically located with respect to the longitudinal axis of opening 32.

Figure 5:
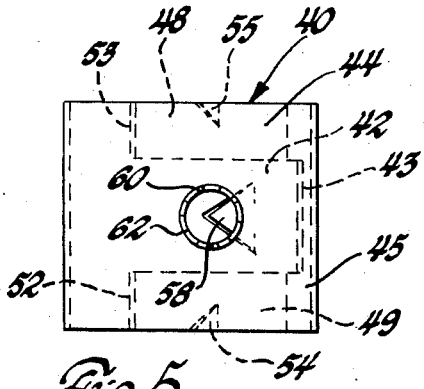
FIG. 5 is a top elevational view of the grounding clip.
Figure 6:
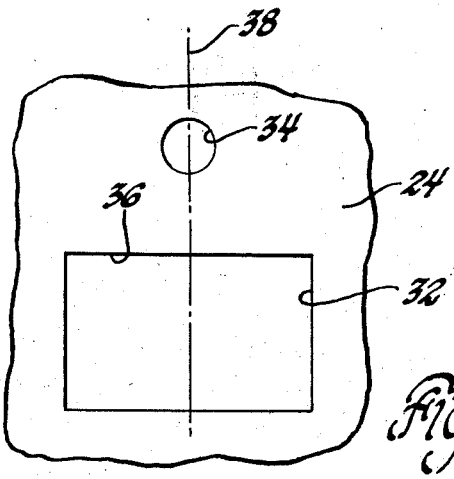
FIG. 6 is a top fragmentary elevational view of the clip receiving portion of the outer casing base wall.

Referring now to FIGS. 5 and 6, applicant's new grounding clip, indicated generally at 40, is formed from a single strip of sheet metal, preferably spring steel having a thickness of 0.018 inches, bent upon itself to form a generally U-shaped member in side elevation including a flat base leaf 42 having an upwardly directed or curved free end 43. The clip includes a resilient body leaf spring 44 overlying and rising from the opposite end of the base leaf 42 inclined upwardly from the horizontal at an acute angle which in the preferred form is approximately 15°. As seen in FIG. 5, the body leaf spring 44 includes a downwardly directed or curved free end 45 that extends a short distance beyond the free end 43 of base leaf 42.

Figure 3:
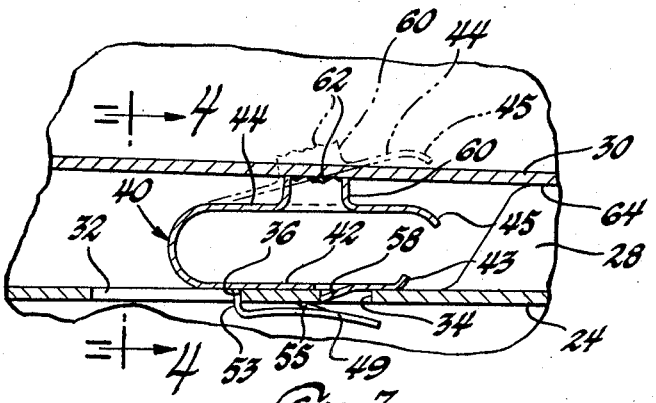
FIG. 3 is an enlarged fragmentary vertical sectional view of the clip contacting the chassis base pan as shown in FIG. 2.
Figure 4:
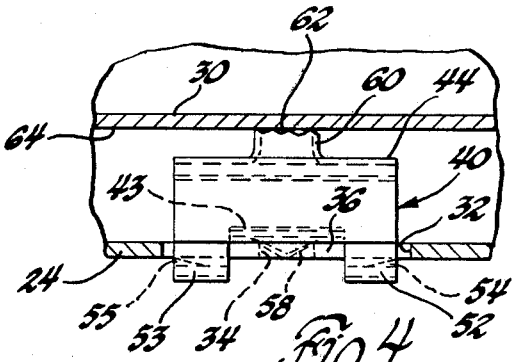
FIG. 4 is a vertical elevational view taken substantially on the lines 4—4 of FIG. 3.

The base leaf 42 has resilient tongues 48 and 49 lanced from each side thereof with each of the tongues 48, 49 being bent from its point of attachment to the base leaf at a generally right angle to form depending stop portions 52 and 53. As best seen in FIG. 3, each of the stop portions 52, 53 are adapted to contact or engage the transverse edge 36 of work opening 32 upon the resilient tongues 48 and 49 being inserted through opening 32 for positioning beneath the bottom wall 24. It will be noted that the tongues are of mirror image identity and each is bowed or upwardly curved in longitudinal section with barb means in the form of an upwardly extending sharp-cornered barb lanced out of its associated tongue as shown at 54 and 55 for tongues 48 and 49, respectively. The barbs 54, 55 are each located at the apex point on its associated tongue such that the resilient upward force exerted by the tongues causes each barb to penetrate the undersurface of wall 24 to insure good electrical contact with the casing.

Figure 7:
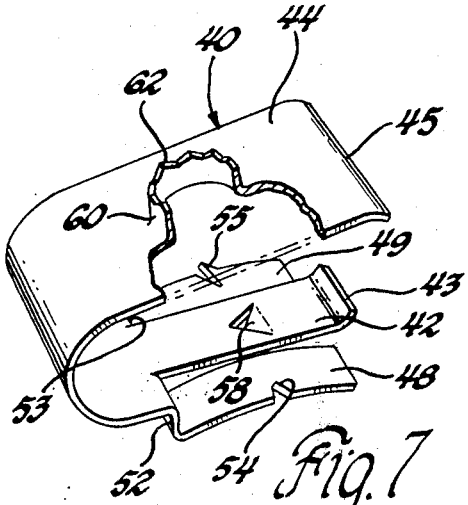
FIG. 7 is an enlarged perspective view of the grounding clip with portions broken away.

As shown in FIG. 7, the base leaf 42 has tang means in the form of triangular tang 58 struck downwardly therefrom inclined so as to extend away from the base leaf free end 43 at an acute angle. With reference to FIG. 3, the tang 58 is adapted to be positioned within the hole 34 shortly before the tongue stop portions 52 and 53 contact the transverse edge 36 to thereby positively lock the grounding clip in its predetermined location whereby it cannot be removed except by means of a tool exerting an upward force on the tang 58. FIGS. 3 and 7 show the body leaf spring 44 formed at its central point with an upwardly extending substantially cylindrical or cone-shaped tubular portion 60 which is suitably formed such as by being punched-out or struck from the body leaf spring 44. The tubular portion has its upper edge formed with a sawtoothed configuration 62 forming a plurality of teeth or barbs arranged to slidably engage the bottom surface 64 of the chassis base 30 so as to penetrate or bite into the surface 64 to insure a good electrical path therebetween. Thus, it will be seen that by virtue of the upwardly inclined free or unbiased position of body leaf spring 44, together with the added height of tubular portion 60 thereon, the chassis base pan will cause the leaf spring 46 to resiliently yield to a deflected position, shown in solid lines in FIG. 3. It will be appreciated that applicant's clip provides a range of positions for the clip leaf spring 44 over which its barbed portion 62 will resiliently engage the base pan surface to provide biting engagement therebetween. The result is that the subject grounding clip 40 will insure proper grounding of the casing to the chassis to compensate for production tolerance variations between the assembled components of the air conditioner.

While the embodiment of the present invention as herein disclosed constitutes a preferred form, it is to be understood that other forms might be adopted.

I claim:

1. A grounding clip made of spring steel material for use with electrical appliances having an outer cabinet of electrical conductive material with an access opening at one end thereof, an inner chassis removably positioned in said cabinet, including a substantially horizontally disposed base pan of electrically conductive material supporting an operating system including electrical conductive components connected to ground, a rectangular work opening and adjacent hole formed in the bottom wall of the cabinet, the hole being symmetrical with and located a predetermined distance from the inboard transverse edge of the work opening, said clip comprising a single sheet of metal bent upon itself to provide a U-shaped spring with a flat base having an upwardly directed free end, a resilient body plate inclined to and rising from the opposite end of said base, said base having a tang struck downwardly therefrom away from said base free end at an acute angle and adapted to be positioned within said cabinet hole, resilient tongues lanced from each side of said base and adapted to engage the underside of said bottom wall and act as leaf springs to clamp said base to the upper side of said bottom wall, each said tongue being bent normal from its point of attachment with said base to form a stop adapted to engage said work opening transverse edge upon said tang being positioned in said cabinet hole, said tongues being upwardly curved in longitudinal section and having sharp-cornered upwardly extending barbs lanced therefrom for digging into in an electrically contacting manner the underside of the cabinet bottom wall, and said body plate having an upwardly extending substantially cylindrical portion struck therefrom with sawtoothed contact means on the upper end thereof adapted to resiliently engage and dig into the bottom surface of the chassis pan upon the chassis being slid into the access opening to electrically ground the cabinet through the electrical conductive components.

2. In a room air conditioner having an outer cabinet of electrical conductive material with an access opening (12) at one end thereof, an inner chassis removably positioned in said cabinet, including a base pan of electrically conductive material supporting a refrigeration system including electrical conductive components connected to ground, a rectangular work opening and adjacent hole formed in the bottom wall of said cabinet, said hole symmetrical with and located a predetermined distance from the inboard trnasverse edge of the work opening, a clip for electrically grounding said cabinet to said chassis comprising a single sheet of spring steel material bent upon itself to provide a U-shaped spring with a flat base having an upwardly directed free end, a resilient body plate inclined to and rising from the opposite end of said base, said base having a tang struck downwardly therefrom away from said base free end at an acute angle and adapted to be positioned within the cabinet hole, resilient tongues lanced from each side of said base and adapted to engage the underside of said bottom wall and act as leaf springs to clamp said base to the upper side of said bottom wall, each said tongue being bent from its point of attachment to said base at a right-angle to form a stop adapted to engage said work opening transverse edge upon said tang being positioned in said cabinet hole, said tongues being upwardly curved in longitudinal section and having sharp-cornered upwardly extending barbs for penetrating in an electrically contacting manner the underside of the cabinet bottom wall, and said body plate having an upwardly extending substantially cylindrical portion struck therefrom with sawtoothed contact means on the upper end thereof adapted to resiliently engate and penetrate the bottom surface of the chassis pan to electrically ground the cabinet through the refrigeration system components.

3. In a room air conditioner having an outer cabinet of electrical conductive material with an access opening at one end thereof, an inner chassis removably positioned in said cabinet, including a base pan of electrically conductive material supporting a refrigeration system including electrical conductive components connected to ground, a rectangular work opening and adjacent hole formed in the bottom wall of said cabinet, said work opening and said hole both being aligned on a longitudinal axis substantially intermediate the side walls of said casing such that said hole is symmetrical with and located a predetermined distance from the inboard transverse edge of the work opening, a clip for electrically grounding said cabinet to said chassis comprising, a single sheet of spring steel material bent upon itself to provide a U-shaped spring with a flat base having an upwardly directed free end, a resilient body plate inclined to and rising from the opposite end of said base at an angle of about 15° from the horizontal, said base having a tang struck downwardly therefrom away from said base free end at an acute angle and adapted to be positioned within said cabinet hole, resilient tongues lanced from each side of said base and adapted to engage the underside of said bottom wall and act as leaf springs to clamp said base to the upper side of said bottom wall, each said tongue being bent from its point of attachment to said base at a right-angle to form a stop adapted to engage said work opening transverse edge upon said tang being positioned in said cabinet hole, said tongues being upwardly curved in longitudinal section and having sharp-cornered upwardly extending barbs lanced therefrom at the apex of the curve for penetrating in an electrically contacting manner the underside of the cabinet bottom wall, and said body plate having an upwardly extending substantially cylindrical portion struck therefrom with sawtoothed contact means on the upper end thereof adapted to resiliently engage and penetrate the bottom surface of the chassis pan upon the chassis being slid into the access opening to electrically ground the cabinet through the refrigeration system components.

* * * * *